United States Patent [19]

Greisner

[11] Patent Number: 4,803,808

[45] Date of Patent: Feb. 14, 1989

[54] WINDOW INCLUDING A CASEMENT FRAME PIVOTED TO A STATIONARY FRAME AND A LOCKING DEVICE FOR THE CASEMENT FRAME MOUNTED ON THE STATIONARY FRAME

[75] Inventor: Paul Greisner, Telgte, Fed. Rep. of Germany

[73] Assignee: Aug. Winkhaus GmbH & Co. KG, Fed. Rep. of Germany

[21] Appl. No.: 58,992

[22] Filed: Jun. 8, 1987

[51] Int. Cl.[4] ..... E05C 9/02

[52] U.S. Cl. ..... 49/394; 49/395; 292/9; 292/36; 292/DIG. 20

[58] Field of Search ..... 49/339, 346, 395, 394; 292/DIG. 20, 9, 40, 36

[56] References Cited

U.S. PATENT DOCUMENTS

| | | | |
|---|---|---|---|
| 1,817,785 | 8/1931 | Vance | 49/395 X |
| 1,820,715 | 8/1931 | Vance | 49/395 X |
| 3,362,107 | 1/1968 | Ewing | 49/339 |
| 3,949,525 | 4/1976 | Bates et al. | 49/395 |

FOREIGN PATENT DOCUMENTS 2733710 2/1979 Fed. Rep. of Germany .

*Primary Examiner*—Philip C. Kannan

*Attorney, Agent, or Firm*—Toren, McGeady & Associates

[57] ABSTRACT

A swivel fitting for an outwardly opening window, with a device for moving the casement frame between the closed position and the open position, for example in the form of a hand crank, with position-fixing arm driven by the crank and with an operating handle on one frame member of the stationary frame, in order to fix the casement frame in the closed position. At least one locking plate is included on the casement frame which co-operates with a locking element on a drive rod operable by the handle. When the window is in the closed position, a locking projection of the locking plate protrudes into a groove in the stationary frame so that the closing movement of the window may be supported relatively early by actuation of the handle and to ensure high security against break-in.

12 Claims, 3 Drawing Sheets

WINDOW INCLUDING A CASEMENT FRAME PIVOTED TO A STATIONARY FRAME AND A LOCKING DEVICE FOR THE CASEMENT FRAME MOUNTED ON THE STATIONARY FRAME

FIELD OF THE INVENTION

The invention relates to a swivel fitting for a window, namely of the construction type in which a casement frame is openable outwards (from the inside of the frame towards the outside) with the aid of an appropriate device, for example in the form of a hand crank fitted on a stationary frame and pivoting a pivot arm acting on the casement frame. In order to secure the casement frame in the closed position on the stationary frame, an operating handle, with which drive rod means can be actuated, is fitted on the frame member of the stationary frame remote from the pivot axis. Locking elements on drive rod means act on a locking plate of the casement frame in the closed position of the casement frame and in the locking position.

DESCRIPTION OF THE PRIOR ART

Windows which are provided with such a swivel fitting are known per se. In this case, the locking plate is situated here within the external circumferential surface (frame rabbet circumferential surface) of the casement frame, which is perpendicular to the plane of the casement, thus in no case does it protrude beyond the inner side, parallel to the casement plane, of the casement frame (casement inner side). Accordingly, the closing movement can be supported by actuation of the operating handle only when the window is almost completely closed, since only then does the locking plate come into the region of the locking element. The supporting of the closing movement shortly before the closure position is reached, by actuation of the operating handle, is important because at the end of the closing movement the operating force to be applied by the device for moving the casement frame into the closure position (hand crank with pivot arm) rises greatly. The seal sections, which are more or less compressed when the window is situated in the closed position, render complete closure of the window more difficult. Moreover the force transmission conditions in general deteriorate with increasing degree of closure of the window, so that for a pre-determined casement closure torque a hand crank torque rising with the degree of closure results. It is to be noted that the locking plate must be mechanically stable, so that opening of the window by force, for example in an attempted break-in, is at least made much more difficult.

SUMMARY OF THE INVENTION

An object of the invention consists in preparing a swivel fitting for an outwardly opening window which, with high security against break-in ensures a simplified operability in that the closing movement of the window can be supported by actuation of the operating handle in an enlarged angular range before the closure position is reached.

This object is achieved in that the locking plate is formed with a locking protuberance protruding over the inside of the casement, which protuberance, when the casement frame is in the closed position, engages in a groove of the second frame member of the stationary frame, with at most a slight spacing between a side face of the locking protuberance, which is substantially perpendicular to the plane of the casement and substantially parallel to the second frame member of the casement frame, and a side face of the groove, and with a blocking face on a side of the locking protuberance lying opposite to the side face, which extends substantially perpendicularly to the side face, and with which blocking face the locking element engages in the closure position of the casement frame and, at the same time, in the locking position of the drive rod means.

Since the locking plate protrudes with its locking protuberance over the inner side of the casement, the locking element can already come into engagement with the locking protuberance at a relatively large angle between casement plane and frame plane in the closing of the window so that then it is only necessary to operate the handle in order fully to close the window. Nevertheless, the security against break-in is high, since even when the second frame member of the casement frame is forced in the opening direction away from the second frame member of the stationary frame, the locking plate cannot be bent, in the region of the locking protuberance, in the direction away from the locking element, since the locking protuberance is situated within the groove of the second frame member. Without this measure the locking plate could be bent back in the region of the locking protuberance, since the locking protuberance protrudes over the inner side of the casement and therefore is not supported at the back by the second frame member of the casement frame.

It is suggested that the side face of the locking protuberance lies on the side of the locking protuberance facing the pivot axis. Then the drive rod means can be arranged in the usual way in the region of the internal circumferential surface, facing the second pivot axis, of the second frame member of the stationary frame.

If, in the mentioned attempted break-in, the closed casement frame is pulled outwards, then the side face of the locking protuberance comes to abut on the groove side face, whereby bending back of the locking protuberance, as a whole, is prevented. In order additionally to preclude breaking off of the cross rib carrying the blocking face and formed on the locking protuberance, it is proposed that the locking protuberance be provided with a stiffening rib which extends along the locking plate in a rib plane perpendicular to the casement plane and to the second frame member of the casement frame.

The locking protuberance is preferredly formed by a cross rib extending parallel to the second frame member of the casement frame, from which the stiffening rib departs in a perpenicular direction. In this way, the mechanical strength of the locking protuberance against forces occurring in the break-in is substantially increased. This mechanical strength is substantially retained if the height of the stiffening rib with which the stiffening rib protrudes from the locking plate decreases in the direction away from the transverse rib. This gives a more compact construction form with a saving of material.

The blocking face can have a tightening section extending at an inclination to the second frame member, in order to facilitate the closing of the window.

In order that the same locking plate may be used unchanged even in the case of type of hanging (from right hung to left hung), it is proposed that the locking plate be formed in mirror symmetry in relation to the rib plane of the stiffening rib.

The drive rod means can be formed by drive rods which can be mounted with the aid of hollow-cylindrical guide elements, by means of securing elements (for example securing screws) penetrating these hollow-cylindrical guide elements, on the second frame member of the stationary frame, with the possibility of movement in the direction of the frame member (that is longitudinal direction of this frame member). For this purpose, the guide element passes through a corresponding slot of the drive rod. Cover rails covering the drive rod can be eliminated, since a collar of enlarged diameter of the guide element rests on the front of the drive rod. The axial length of the section of the guide element penetrating the slot of the drive rod can be almost exactly as large as or somewhat larger than the metal thickness of the drive rod, so that the drive rod rests directly on the frame inner circumferential surface of the frame member. The danger of bending of the drive rod towards the second frame member under compression stressing is reduced by this measure.

For the adjustment of the locking element after fitting and possibly for readjustment after lengthy operation, the locking element is preferredly formed with a bolt head, which is rotatable about a bolt head axis and securable in different positions in rotation, with bolt head circumferential surface eccentric in relation to the bolt head axis.

In addition to or even independently of the measures stated above, early grasping of the locking plate by the corresponding locking element to support the closing movement can also be achieved in that the locking element is fitted on a front, perpendicular to the frame plane, of a drive rod, with less spacing from the drive rod longitudinal edge nearest to the frame outer side than from the drive rod longitudinal edge nearest to the frame inner side.

BRIEF DESCRIPTION OF THE DRAWINGS

The invention will be explained below by means of a preferred example of embodiment by reference to the drawing, wherein.

DESCRIPTION OF THE PREFERRED EMBODIMENT

Figure 1:
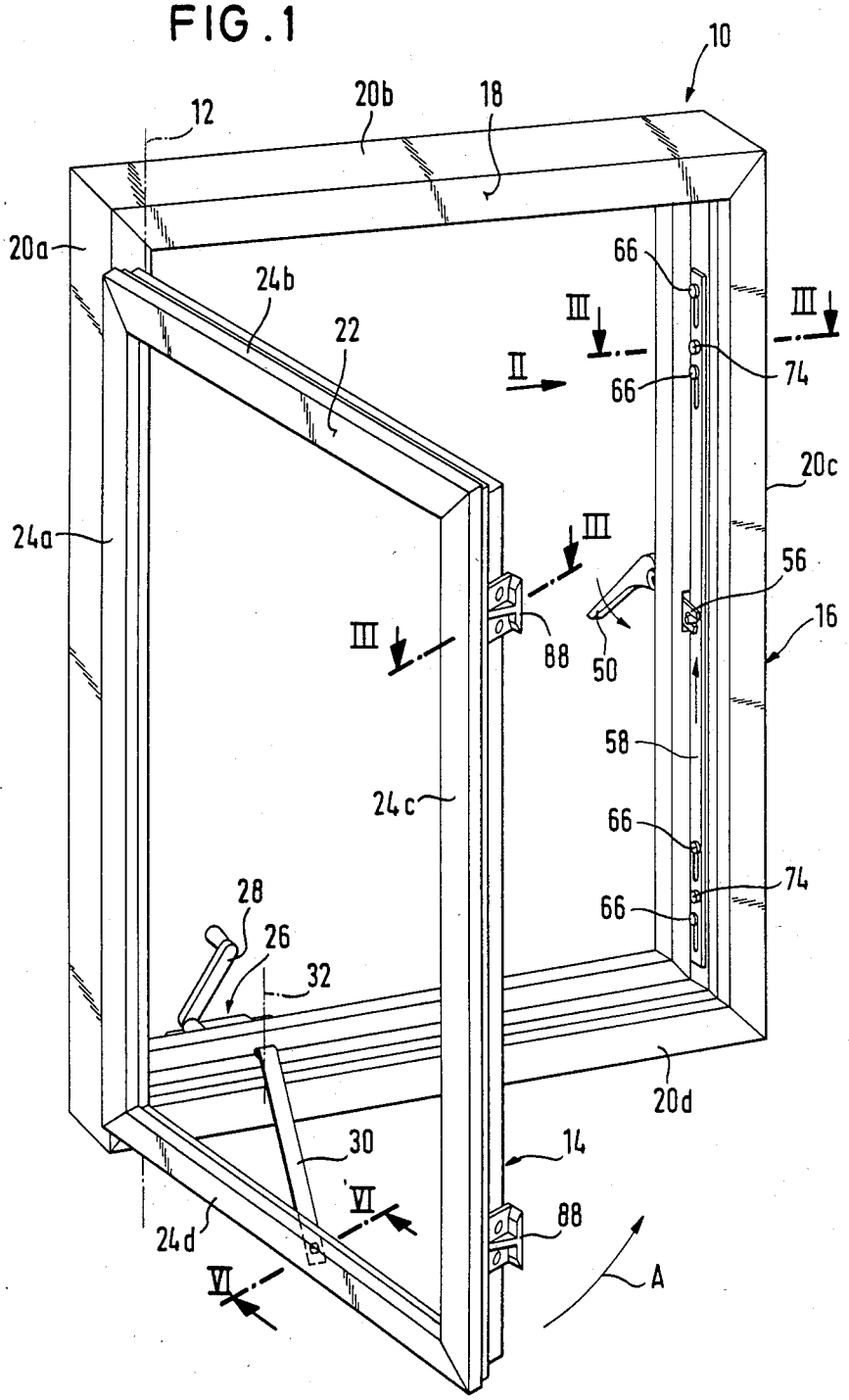
FIG. 1 shows a simplified isometric representation of a half-opened window provided with a swivel fitting in accordance with the invention.

The window 10 as represented in the Figures is a window in which a casement frame 14 is fitted on a stationary frame 16 for pivoting about only one single axis 12. This axis will, in general, be a vertical axis, although in principle a horizontal axis comes under consideration. The casement frame is openable to the exterior. Thus in FIG. 1, there are seen the frame exterior 18 of the stationary frame 16, formed from frame members 20*a* to 20*d* forming a rectangle, and the casement exterior 22 of the casement frame 14 formed, correspondingly, from frame members 24*a* to 24*d*. In order to render possible opening of the window 10 to the exterior, the vertical pivot axis 12 is situated in the region of the frame exterior 18 of the left vertical frame member 20*a* in FIG. 1. An arrow A in FIGS. 1 and 3 designates the closing direction in the passage of the casement frame 14 from the open position into the closed position 14' according to FIG. 3.

Figure 6:
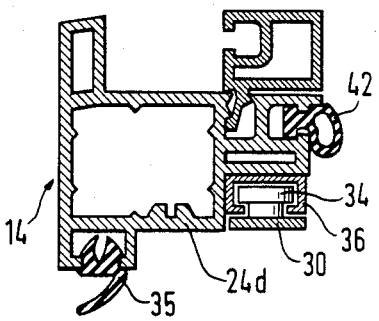
FIG. 6 shows a section along the line VI—VI in FIG. 1.

In order that the opening and closing movements of the casement frame 14 can be controlled from the interior, on the interior of the stationary frame 16, a device 26 (position-fixing device) is fitted with, for example, a hand crank 28 which, through a worm gearing, can set a position-fixing arm 30 into a pivoting movement about a pivot axis 32 parallel to the axis 12. The pivot axis 32 of the position-fixing arm 30 is situated in the region of the lower horizontal frame member 20*d*, at a distance from the axis 12. According to FIGS. 1 and 6 a roller 34 fitted on the free end of the arm 30 engages in a rail 36 of C-shaped cross-section which extends along the lower, horizontally extending frame member 24*d* of the casement frame 14. In a pivoting movement of the frame the roller 34 slides along the rail 36 to entrain the casement 14 in accordance with the pivoting movement of the arm 30.

Figure 3:
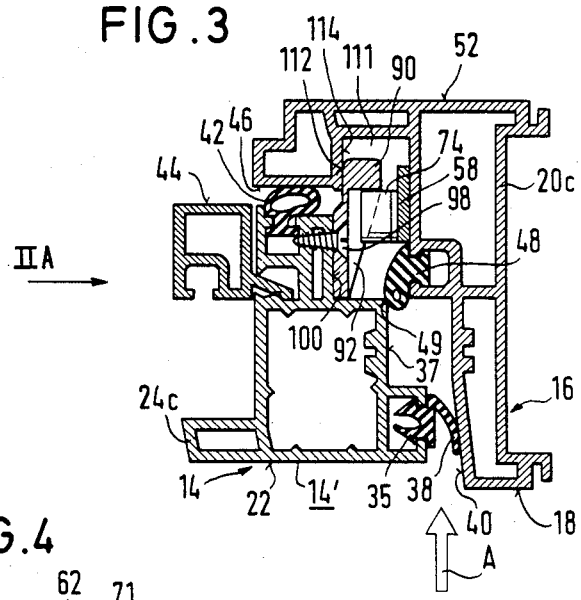
FIG. 3 shows a sectional view along the line III—III in FIG. 1.

By actuation of the hand crank 28, the casement frame 14 can be moved, for example, in the closing direction (arrow A). Immediately before the closure position according to FIG. 3 is reached however, the torque necessary to rotate the hand crank 28 increases greatly, primarily because at the end of the closing movement seal sections provided on the casement frame 14 and/or on the stationary frame 16 come to abut on sealing faces associated therewith, with more or less intense compression of the seal section concerned. In FIG. 3 there is seen, for example, such a seal section 35 which is fitted close to the frame exterior 22 on the external circumferential surface (frame rabbet circumferential surface) 37 of the casement frame 14 and the sealing lip 38 of which comes to abut on a seal face 40 of the stationary frame 16. A further seal section 42 on the casement frame 14 in the region of the casement interior 44 comes to abut on a seal face 46 of the stationary frame 16. Furthermore, a seal section 48 is provided on the stationary frame 16 and comes to abut on a step edge 49 of the frame member of stepped formation of the casement frame 14.

The lever ratios also become more unfavorable in the region of the closure position 14' (position-fixing arm 30 parallel to the lower horizontal frame member 24*d*).

Figures 2A, 2B:
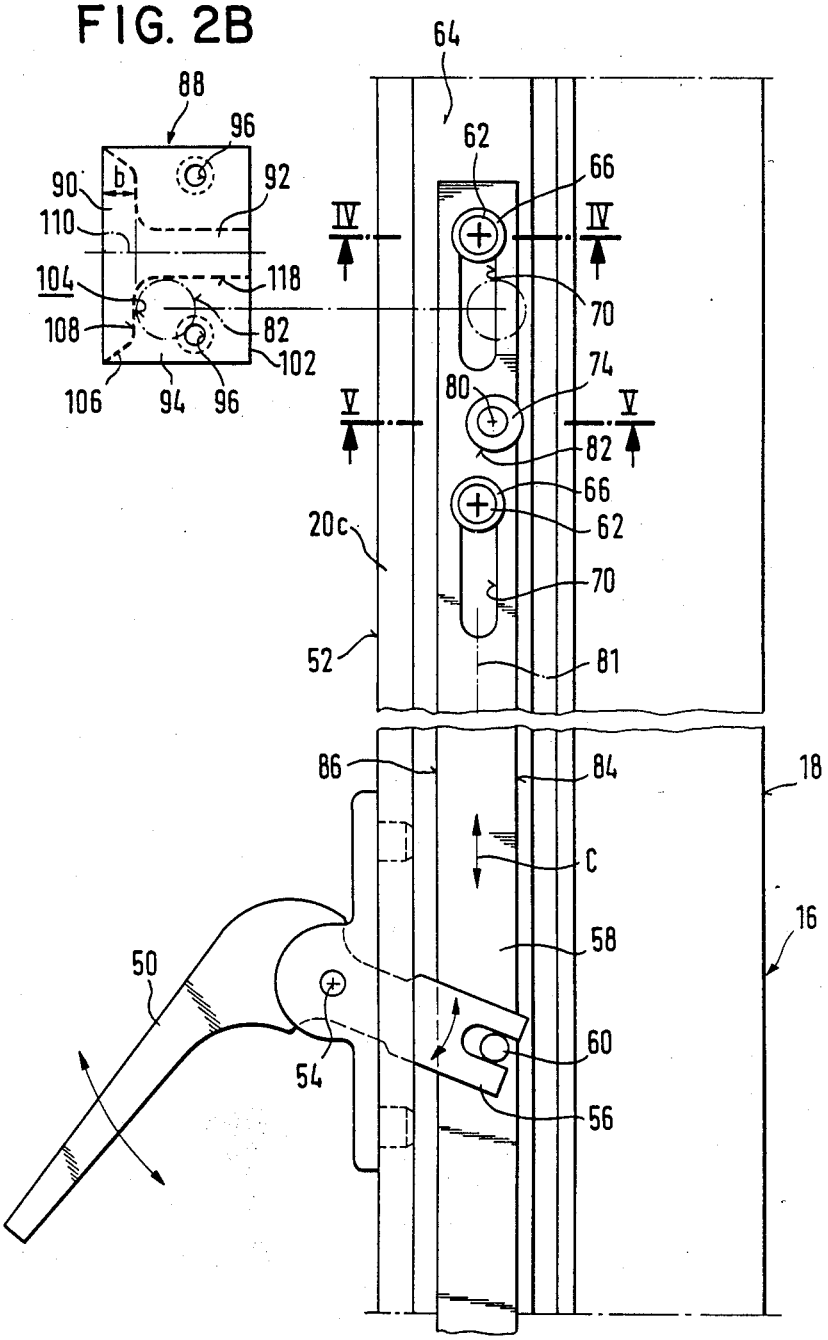
FIG. 2A shows a detail view in the direction of arrow II in FIG. 1 of a frame member of the stationary frame.
FIG. 2B shows a back view of a locking plate, viewed in the direction of arrow IIA in FIG. 3.
Figure 4:
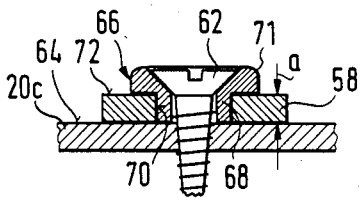
FIG. 4 shows a detail section along the line IV—IV in FIG. 2A.

To support the end phase of the closing movement an operating handle 50, visible in FIGS. 1 and 2A, can be actuated, which is fitted on the interior 52 of the stationary frame 16 on the vertical frame member 2C remote from the pivot axis 12. The operating handle 50 is pivotable about a horizontal spindle 54 and through a fork 56 rigidly connected with the handle 50, drives an entraining bolt 60 fitted on a drive rod 58. In this way, the drive rod 58 can be displaced up and down in the vertical direction C, that is, in the longitudinal direction of the drive rod 58. The drive rod 58 is mounted on the frame member 20*c* by means of securing elements 62 (for example countersunk screws) visible in FIGS. 2A and 4 on an internal circumferential surface 64 of the stationary frame 16. In this case each securing element 62 passes through a hollow-cylindrical guide element 66. A section 68 of the guide element 66 passes through a slot 70 of the drive rod 58. Its axial length corresponds to the thickness a of the drive rod. The section 68 is adjoined by a collar 71 of enlarged diameter, which rests on the drive rod front 72 facing away from the frame member 20. In this way the guide rail 58, resting on the casement frame 14, is retained displaceably in the direction C.

According to FIGS. 1 and 2A, two of these guide elements 66 are provided both in the region of the upper end and in the region of the lower end of the drive rod 58, each with an associated slot 70. A locking element 74, in each case fitted between the respective slots 70 on the drive rod 58, can therefore be loaded even with great forces, without danger of bending of the drive rod 58. Each of the two locking elements 74 (FIG. 1) is provided with a bolt head 76 which is rotatable on a rivet bolt riveted to the drive rod 58, about a bolt head axis 80, and can be made fast in various positions in rotation. As may be seen from Figure 2, the bolt head circumferential surface 82 is arranged eccentrically on the axis 80, in order that the casement application pressure in the closure position 14' may be adjusted according to choice. The locking element 74 can be made in accordance with German publishing application No. 2,733,710 (A-document).

Figure 5:
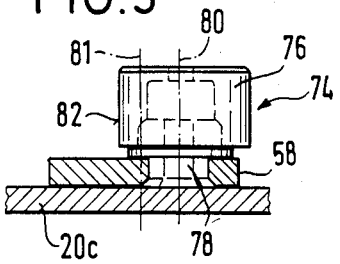
FIG. 5 shows a detail section along the line V—V in FIG. 2A.

It can further be seen from FIGS. 2A and 5 that the locking element, in contrast to the guide elements 66, is not arranged on the longitudinal central plane 81 of the drive rod 58, but is shifted closer to that drive rod longitudinal edge which in turn lies closer to the frame exterior 18. This longitudinal edge is designated by 84 in FIG. 2 and the other longitudinal edge by 86. It should be pointed out that the drive rod 58 is formed by an elongated flat bar which is arranged in a vertical plane perpendicular to the plane of the frame.

By reason of the mentioned shift of the two locking elements 62 from the middle of the width of the drive rod 58, which defines the longitudinal central plane 81, in the direction towards the outside 18 of the frame, it occurs that the locking element in each case already engages with a locking plate 88 secured to the casement frame 14 and to be described hereinafter with reference to FIGS. 2A and 3, when the casement frame is not yet quite closed.

The special configuration of the locking plate 88 also serves for this purpose. As shown in FIG. 2B, itcomprises a cross rib 90, called locking protuberance, extending in the vertical direction, from which a stiffening rib 92 departs at right angles in the region of the middle of the length of the cross rib 90. In this way a substantially T-shaped flange results which protrudes from a rectangular plate 94. The plate 94 is provided, on each of the two sides of the stiffening rib 92, with a securing hole 96 into which a screw 98 is screwed according to FIG. 3, for securing to a mounting surface 100 extending along the external circumference of the frame member 24c. As FIG. 3 also shows, the height of the stiffening rib 92 by which it protrudes from the plate 94 decreases continuously in the direction away from the cross rib 90, to the longitudinal edge 102 of the plate 94 lying opposite to the stiffening rib 92.

The side of the cross rib 90 facing the said longitudinal edge 102 forms a blocking face 104 with which the bolt head 76 engages with its circumferential face 82, eccentric of the bolt axis 80, in the closing of the casement frame 14.

The blocking face 104 consists of a first section 106 extending at an inclination to the longitudinal direction of the frame member 24 and serving as tightening slope and a second section 108 extending parallel to the frame member 24c and lying in a plane parallel to the plane of the casement frame. The locking plate 88 is made, according to FIG. 2, symmetrical in relation to a central plane 110 passing through the stiffening rib 92 and perpendicular to the plate 94, so that the same part can be used unchanged either for a left-hung or a right-hung window, as also can the drive rod 58 with its laterally offset locking elements 74.

As FIG. 3 shows, the locking plate 88 protrudes beyond the inner side 44 of the casement by somewhat more than the width b of the cross rib 90, so that necessarily the cross rib 90 does not rest on its back on the frame member 24c and per se, by reason of absence of support by the frame member 24c in this region, the danger exists that the cross rib 90, on heavy loading by the locking element 74, bends in the direction away from the locking element and under certain circumstances breaks away (for example in the case of a forcible attempt at opening the window). Such yielding is however precluded, according to the invention, in that the locking plate 88 penetrates with its cross rib 90 into a groove 111 of the frame member 20c of the stationary frame 16, as soon as the casement frame assumes its closed position 14'. The groove 111 is accordingly open in a direction opposite to the closure direction A according to FIG. 3. The side face (rear) 112 of the cross rib 90, facing the pivot axis 12, has at most a slight spacing from the opposite side face 114 of the groove 111, so that under loading by the locking protuberance 74 the cross rib 90 immediately comes into abutment on the side face 114 of the groove 111. Thus bending of the cross rib 90 is precluded. A closed force path results by way of the drive rod 58 mounted on the frame member 20c through the locking protuberance 74 and the cross rib 90 and the side face 114 of the groove 111 back to the frame member 20c.

In this way a reliable protection against break-in is obtained. At the same time the closing of the casement frame is facilitated in that the closing movement can be substantially facilitated by actuation of the handle 50 even relatively early before the closure position 14' is reached, since in this case the bolt external circumference 82 slides along the inclined section 106 of the blocking face 104, serving as tightening slope, with progressive closure of the casement frame 14, until after the reaching of the closure position 14' the external circumference 82 slides along the section 108, possibly with abutment on the corresponding side face 118 of the stiffening rib 92.

I claim:

1. A window comprising a casement frame pivoted to a stationary frame, said stationary frame consisting of stationary frame members which extend along a rectangle defining a frame plane, with a frame exterior parallel to the plane of the stationary frame and a frame interior lying opposite to the frame exterior, said casement frame consisting of a casement frame members which extend along a rectangle defining a casement plane, with a casement exterior parallel to the casement plane and with a casement interior lying opposite to the casement exterior;

said window further comprising pivot bearing means which pivotably connect a first stationary frame member of the stationary frame with a first casement frame member, said first casement frame member being parallel to said first stationary frame member, for the pivoting movement of the casement frame in relation to the stationary frame between a closed position and an open position of the casement frame about a pivot axis, parallel to the first stationary frame member, in the region of the frame outer face of the stationary frame, where, in the closed position of the casement frame, the frame exterior has the same orientation as the casement exterior and where the opening movement of the casement frame takes place from the closed position into the open position in the direction from the frame interior to the frame exterior;

a device for the movement of the casement frame between the closed position and the open position;

drive rod means which are fitted on a second stationary frame member lying opposite to the first stationary frame member, for movement along the second stationary frame member;

an operating handle on the second stationary frame member, on the frame interior, said handle being coupled with the drive rod means for the movement of the drive rod means between a release position and a locking position;

at least one locking element fitted on the drive rod means; and at least one locking plate, which is fitted on a second casement frame member of the casement frame lying opposite to the first casement frame member and upon which said at least one locking element acts, wherein the locking plate is formed with a locking protuberance protruding over the casement interior, which, in the closed position of the casement frame, engages in a groove of the second stationary frame member, with, at most, a slight spacing between a locking protuberance side face substantially perpendicular to the casement plane and substantially parallel to the second casement frame member and a side face of the groove and with a blocking face, extending substantially perpendicularly of the side face, on a side of the locking protuberance lying opposite to the side face, with which blocking face the locking element engages in the closed position of the casement frame and, at the same time, in the locking position of the drive rod means.

2. A window according to claim 1, wherein the side face of the locking protuberance lies on the side of the locking protuberance facing the pivot axis.

3. A window according to claim 1, wherein the locking protuberance is formed by a cross rib extending substantially parallel to the second casement frame member.

4. A window according to claim 3, wherein the locking plate is formed with a stiffening rib which extends from the cross rib in a rib plane substantially perpendicular to the casement plane and to the second casement frame member.

5. A window according to claim 4, wherein the blocking face is formed on a side face of the cross rib facing the stiffening rib.

6. A window according to claim 5, wherein the blocking face comprises a tightening section extending at an inclination to the second casement frame member.

7. A window according to claim 4, wherein the height of the stiffening rib with which the stiffening rib protrudes from the locking plate decreases in the direction away from the cross rib.

8. A window according to claim 4, wherein the locking plate is made in mirror symmetry in relation to the rib plane of the stiffening rib.

9. A window according to claim 1, wherein the drive rod means comprises at least one drive rod with a drive rod front from which the at least one locking element (74) protrudes and with a drive rod rear which rests on the second stationary frame member, with a substantially hollow-cylindrical guide element which passes through a slot of the drive rod and comprises a collar of enlarged diameter which rests on the drive rod front, and with a securing element penetrating the hollow-cylindrical guide element, with which the guide element is mounted on the second stationary frame member.

10. A window according to claim 1, wherein the at least one locking element is formed with a bolt head rotatable about a bolt axis and securable in different positions in rotation, with a bolt head circumferential surface eccentric of the bolt axis.

11. A window according to claim 1, wherein the locking element is fitted on a drive front substantially perpendicular to the frame plane, of a drive rod, with less spacing from a drive rod longitudinal edge placed nearer to the frame exterior than from a drive rod longitudinal edge placed nearer to the frame interior.

12. A window comprising a casement frame pivoted to a stationary frame, said stationary frame consisting of stationary frame members, which extend along a rectangle defining a frame plane, a frame exerior parallel to the frame plane, and a frame interior lying opposite to the frame exterior, and said casement frame consisting of casement frame members which extend along a rectangle defining a casement plane, a casement exterior parallel to the casement plane and a casement interior lying opposite to the casement exterior;

said window further comprising pivot bearing means which pivotably connect a first stationary frame member of the stationary frame with a first casement frame member, parallel to said first stationary frame member, for the pivoting movement of the casement frame in relation to the stationary frame between a closed position and an open position of the casement frame about a pivot axis parallel to the first stationary frame member in the region of the outer face of the stationary frame, where the frame exterior, when the casement frame is in the closed position, has the same orientation as the casement exterior and where the opening movement of the casement frame from the closed position into the open position takes place in the direction from the frame interior to the frame exterior;

a device for the movement of the casement frame between the closed position and the open position;

drive rod means which are fitted on a second stationary frame member, opposite to the first stationary frame member, for movement along the second stationary frame member;

an operating handle on the second stationary frame member on the frame interior, said handle being coupled with the drive rod means for the movement of the drive rod means between a release position and a locking position;

at least one locking element fitted on the drive rod means; and at least one locking plate which is fitted on a second casement frame member of the casement frame lying opposite to the first casement frame member, and with which locking plate said at least one locking element engages, wherein the locking element is fitted on a drive rod front, substantially perpendicular to the frame plane, of a drive rod, with less spacing from a drive rod longitudinal edge placed nearer to the frame exterior than from a drive rod longitudinal edge place nearer to the frame interior.

* * * * *